US005794764A

United States Patent [19]

Hirose et al.

[11] Patent Number: 5,794,764

[45] Date of Patent: Aug. 18, 1998

[54] HIGH-SPEED SEESAW BREAKING SWITCH WITH RAISED FULCRUM AND ACCELERATOR RAMP

[75] Inventors: Hiroyuki Hirose; Hirotaka Tachibana, both of Kanagawa, Japan

[73] Assignee: Satori Electric Co., Ltd., Tokyo, Japan

[21] Appl. No.: 756,535

[22] Filed: Nov. 26, 1996

[51] Int. Cl.[6] ..... H01H 5/08; H01H 13/20; H01H 13/52

[52] U.S. Cl. ..... 200/437; 200/6 B

[58] Field of Search ..... 200/5 R, 6 R, 200/6 B–6 C, 433, 437, 453

[56] References Cited

U.S. PATENT DOCUMENTS

| | | | |
|---|---|---|---|
| 3,935,411 | 1/1976 | Ford | 200/437 |
| 3,944,768 | 3/1976 | Aryamane et al. | 200/453 |
| 4,127,754 | 11/1978 | Josemans et al. | 200/433 |
| 4,241,244 | 12/1980 | Swann | 200/6 R |
| 4,408,105 | 10/1983 | Tanaka | 200/6 BA X |
| 4,524,253 | 6/1985 | Sorenson | 200/6 BA X |
| 4,697,053 | 9/1987 | Lockard | 200/437 |
| 5,293,507 | 3/1994 | Hayakawa | 200/6 B X |
| 5,597,989 | 1/1997 | Nishio | 200/5 R |

*Primary Examiner*—J. R. Scott

*Attorney, Agent, or Firm*—Nikaido, Marmelstein, Murray & Oram LLP

[57] ABSTRACT

A high-speed breaking switch of the seesaw type having an up-and-down contact plate balanced at the middle by the support of the switch body, a push member slidably attached to the up-and-down contact plate to push the up-and-down plate against the support all the time and at least one terminal formed on the switch body to permit one end of the up-and-down contact plate to abut thereon. The up-and-down contact plate has a raised fulcrum vertically at a level which is higher than the level at which the push member abuts on the up-and-down contact plate. The raised fulcrum is formed by a pair of raised fulcrum archs, one on each side of the contact plate. The up-and-down contact plate has a ramp-and-step plateau or inverted "V"-shaped projection formed thereon. This arrangement increases the rotating force or moment of the up-and-down contact plate, thereby increasing the speed at which the connections in an associated electric circuit can be broken, thereby suppressing the arc across the contact-to-contact space.

4 Claims, 3 Drawing Sheets

HIGH-SPEED SEESAW BREAKING SWITCH WITH RAISED FULCRUM AND ACCELERATOR RAMP

BACKGROUND OF THE INVENTION

1. Field of the Invention

The present invention relates to a small-sized switch which is appropriate for use in an electric tool such as a portable electric drill, and more particularly an improvement in or relating to a seesaw type of switch capable of breaking the connections in an electric circuit at an increased speed.

2. Description of Related Art

Referring to FIG. 9, a conventional seesaw type of switch uses a common terminal 1 whose tapering end 1*a* supports an up-and-down contact plate 2. The up-and-down contact plate 2 has contacts formed on its opposite ends, and is pushed against the tapering end 1*a* of the common terminal 1 by an associated spring-biased push member 4, which contains a coiled spring 3 therein.

The pushing and pulling of an associated switching lever (not shown) from the switch body will cause the spring-biased push member 4 to slidably move rightward or leftward on the up-and-down contact plate 2, so that one end of the up-and-down contact plate 2 goes up the other end goes down alternately. Specifically the instant that the round end 4*a* of the spring-biased push member 4 stays on the tapering end 1*a* of the common terminal 1, the up-and-down contact plate 2 is in horizontal, balanced condition, and when the push member 4 moves leftward or rightward, the up-and-down contact plate 2 is inclined until one or the other end of the up-and-down contact plate 2 has been put in contact with the main or counter contact formed in the switch body for making the connections in an electric circuit ("ON" condition).

When the spring-biased push member 4 is moved on the up-and-down contact plate 2 in the opposite direction to traverse the fulcrum of the up-and-down contact plate 2, its inclination will be reversed to break the connections in the electric circuit ("OFF" condition).

The conventional seesaw type of switch, however, cannot break the connections in an electric circuit quickly, and therefore, there is a fear of causing sparks to appear across the contact-to-contact space, thereby deteriorating the contacts of the switch.

Recently the voltage to be applied to electrically driven tools such as electric drills has been increased up to 24 volts DC. Therefore, if the switch cannot break the connections in an electric circuit quickly, an increased amount of electric current is allowed to flow at the instant of circuit-breaking, thereby causing the contacts to melt. There is no choice but to reduce the amount of electric current for preventing the melting of the contacts.

The cause for retarding the circuit-breaking in the seesaw type of switch is that the movable push member 4 cannot move on the up-and-down contact plate 2 quickly. Specifically the push member 4 cannot move one side from the balanced condition in which it stays in alignment with the vertical line passing from the tapering end 1*a* to the center axis of the round end 4*a* at such an increased speed that one end of the up-and-down contact plate 2 goes down the other end goes up so quickly that no arc may be permitted to appear across the inter-contact space or that an arc if permitted to appear, may be suppressed quickly.

Thus, there has been an ever increasing demand for reducing the circuit-breaking time in a seesaw type of switch.

SUMMARY OF THE INVENTION

In view of the above one object of the present invention is to provide a high-speed breaking switch of the seesaw type.

To attain this and other objects a high-speed breaking switch of the seesaw type comprising an up-and-down contact plate balanced at the middle by the support of the switch body, a push member slidably attached to the up-and-down contact plate to push the up-and-down contact plate against the support of the switch body all the time and at least one terminal formed on the switch body at such a position that either end of the up-and-down contact plate may abut on the terminal upon inclination of the up-and-down contact plate, is improved according to the present invention in that the fulcrum of the up-and-down contact plate is raised vertically at a level higher than the level at which the push member abuts on the up-and-down contact plate, and that the up-and-down contact plate has an accelerator ramp formed on the side on which the push member moves on the up-and-down contact plate.

The ramp may be an inclination or slope to traverse the fulcrum of the up-and-down contact plate.

A high-speed breaking switch of the seesaw type comprising an up-and-down contact plate balanced at the middle by the support of the switch body, a push member slidably attached to the up-and-down contact plate to push the up-and-down contact plate against the support of the switch body all the time and at least one terminal formed on the switch body at such a position that either end of the up-and-down contact plate may abut on the terminal upon inclination of the up-and-down contact plate, is improved according to the present invention in that the up-and-down contact plate has an acclerator ramp formed on the side on which the push member moves on the up-and-down contact plate.

The ramp may be an inclination or slope to traverse the fulcrum of the up-and-down contact plate.

The rising of the fulcrum of the up-and-down contact plate at a level higher than the level at which the push member abuts on the up-and-down contact plate has the effect of substantially increasing the moment or rotating force of the up-and-down contact plate in breaking the connections in an electric circuit.

The slope of the ramp traversing the fulcrum of the up-and-down contact plate has the effect of accelerating the speed at which the push member passes through the fulcrum, accordingly expediting the inclination of the up-and-down contact plate in breaking the connections in an electric circuit.

The ramp may be a ramp-and-step plateau or an inverted "V"-shaped projection formed on the up-and-down contact plate.

Other objects and advantages of the present invention will be understood from the following description of high-speed breaking switches of the seesaw type according to preferred embodiments of the present invention, which are shown in accompanying drawings.

DESCRIPTION OF THE PREFERRED EMBODIMENTS

Figure 1:
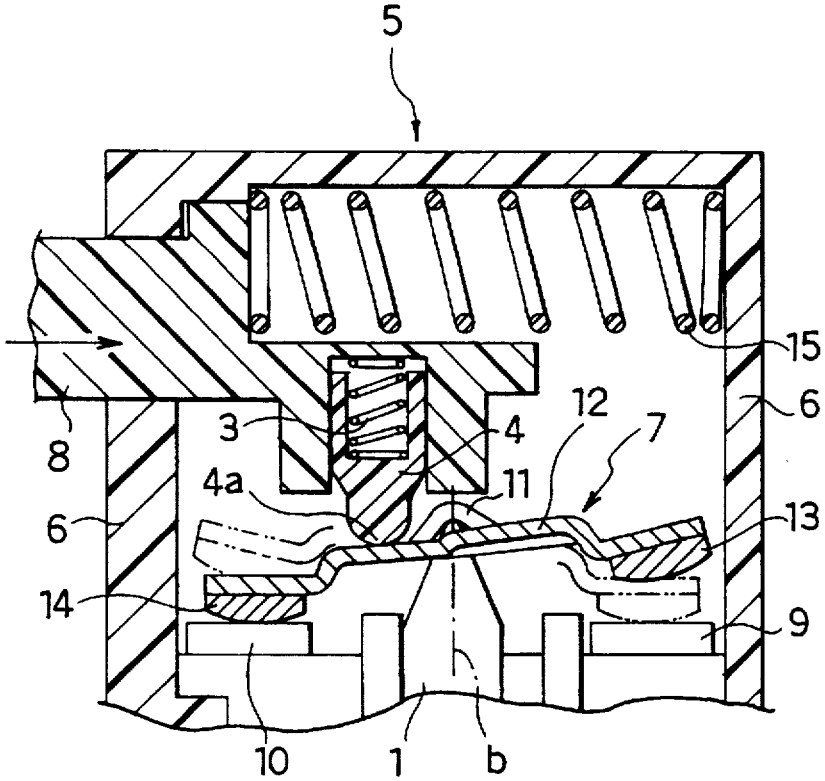
FIG. 1 is a longitudinal section of a selected part of a high-speed breaking switch according to a first embodiment of the present invention.
Figure 2:
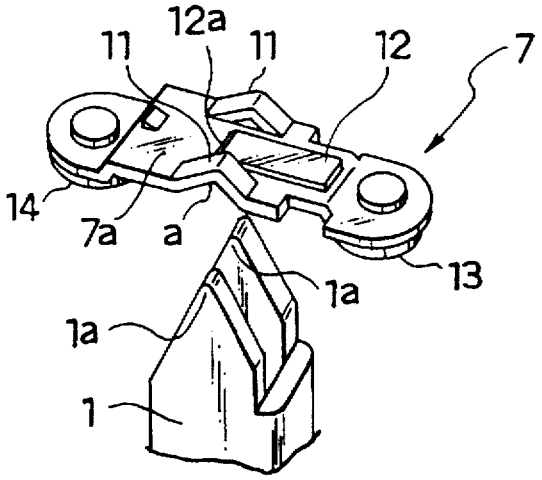
FIG. 2 is a perspective view of the common terminal or support and the up-and-down contact plate in the high-speed breaking switch.

Referring to FIGS. 1 and 2, a high-speed breaking switch of the seesaw type according to the first embodiment of the present invention comprises, in an insulating casing 6, a common terminal 1 extending into the inner space of the insulating casing 6 and functioning as a tapering support, an up-and-down contact plate 7 balanced at the middle by the tapering end 1*a* of the common terminal 1, the up-and-down contact plate 7 having sub-contacts 13 and 14 formed at its opposite ends, a push member 4 slidably abutting the up-and-down contact plate 7 under the influence of coiled spring 3 all the time, a lever 8 slidably mounted in the insulating casing 6, partly appearing outward therefrom, and containing the coiled spring 3 and the push member 4 therein, and main and sub-contacts 9 and 10 positioned to be put be put alternately in contact with either contact 13 or 14 of the up-and-down contact plate 7 for making or breaking the connections in an associated electric circuit.

As seen from these drawings, the up-and-down contact plate 7 turns at its middle fulcrum point "a". The fulcrum point "a" of the up-and-down contact plate 7 is raised vertically (along the vertical line "b" passing through the fulcrum point "a") at a level higher than the horizontal level at which the upper surface 7*a*of the up-and-down contact plate 7 remains horizontal in balanced condition. The middle fulcrum point "a" is formed by two raised fulcrum points 11 on the lateral side portions of the contact plate 7 leaving a space therebetween.

Figure 9:
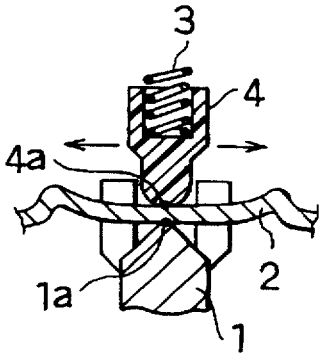
FIG. 9 PRIOR ART
FIG. 9 shows, in section, how the connection-breaking is effected in a conventional seesaw type of switch.

When the up-and-down contact plate 7 is balanced at its middle fulcrum point with the round end 4*a* of the spring-biased push member 4 aligned vertically with the tapering ends 1*a* of the common terminal 1, the fulcrum point "a" is at a level higher than the up-and-down contact plate 7, which is the reverse of the conventional seesaw type of switch (FIG. 9) whose fulcrum point is at a lower level than the the up-and-down contact plate 2. In the horizontal, balanced position of the up-and-down contact plate 7 the round end 4*a* of the spring-biased push member 4 can stay on the up-and-down contact plate 7 in vertical alignment with the opposite fulcrum points "a" on the tapering ends 1*a* of the common terminal 1. The round end 4*a* passes between the raised fulcrum points 11.

In order to increase the rotating force or moment of the up-and-down contact plate 7 the rising amount of the fulcrum points 11 is determined to be large compared with the thickness of the up-and-down contact plate 7.

The up-and-down contact plate 7 has a ramp-and-step plateau 12 formed on its upper surface 7*a* in the way on which the round end 4*a* of the push member 4 travels in the space between the raised fulcrum points 11. The ramp-and-step plateau 12 has an inclination 12*a* formed on one lateral edge, and is positioned so that its ramp may traverse the fulcrum "a" of the up-and-down contact plate 7. Specifically the inclination 12*a* is located at such a position that the vertical line "b" may pass through the inclination 12*a* and the fulcrum "a".

Figure 3:
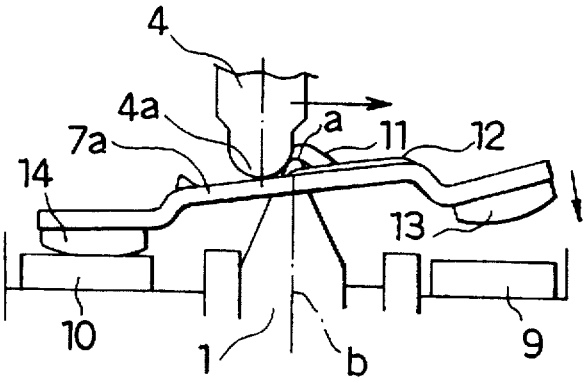
FIG. 3 illustrates how the connection-breaking is effected in the high-speed breaking switch.
Figure 4:
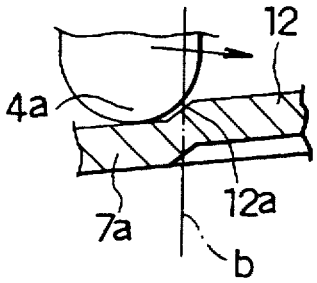
FIG. 4 illustrates how the round end of the push metal climbs the inclination of the ramp formed on the up-and-down contact plate.

Referring to FIG. 3, in operation, the pushing-in of the lever 8 against the counter spring 15 will cause the push member 4 to slide rightward (in the direction indicated by arrow in the drawing) on the upper surface 7*a* of the up-and-down contact plate 7. As the round end 4*a* of the push member 4 is getting close to the fulcrum "a" at which the up-and-down contact plate 7 is supported by the opposite tapering supports 1*a*, the round end 4*a* of the push member 4 starts climbing the inclination 12*a* of the ramp-and-step plateau 12. Then, the up-and-down contact plate 7 turns so that the switch 5 may switch one contact-connecting position in which one contact 14 of the up-and-down contact plate 7 is put in contact with the sub-contact 10 to another contact-connecting position in which the other contact 13 of the up-and-down contact plate 7 is put in contact with the main contact 9, thereby making an electric connection between the main contact 9 and the common terminal 1 (see phantom lines).

The instant that the contact-connecting position is switched on, the push member 4 climbs the inclination 12*a* of the ramp-and-step plateau 12 by compressing an associated spring 3, thus increasing the resilient load to the lever 8 with the result that the speed at which the lever 8 moves rightward is reduced, and that the switching to the circuit-making position is somewhat retarded.

Figure 5:
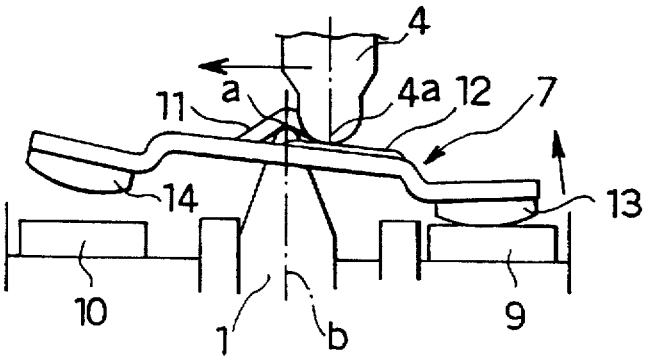
FIG. 5 illustrates how the connection-making is effected in the high-speed breaking switch.
Figure 6:
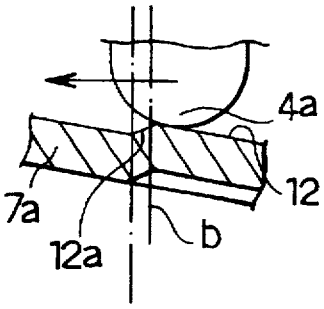
FIG. 6 illustrates how the round end of the push member slides along the slope of the ramp.

Next, referring to FIG. 5, in switching to the reversal, circuit-breaking position by separating the contact 13 from the main contact 9 as indicated by arrow in the drawing, the round end 4*a* of the push member 4 traverses the vertical line "b" passing through the fulcrum "a", falling down along the inclination 12*a* quickly, thereby causing the up-and-down contact plate 7 to turn quickly, as seen from FIG. 6.

By allowing the compressed spring 3 to extend a distance equal to the height of the step-like projection of the ramp-and-step plateau 12 the round end 4*a* of the push member 4 is accelerated to push the up-and-down contact plate 7.

Thus, the turning moment is quickly applied to the up-and-down contact plate 7, and as the distance from the fulcrum "a" to the point 4*a* at which the round end 4*a* of the push member 4 abuts against the up-and-down contact plate 7 is relatively long, such turning moment is increased, thereby increasing the breaking speed at which the contact 13 is separated from the main contact 9. Thus, the arc appearing across the contact-to-contact space can be suppressed, and therefore, deterioration of the contacts can be prevented.

Figure 7:
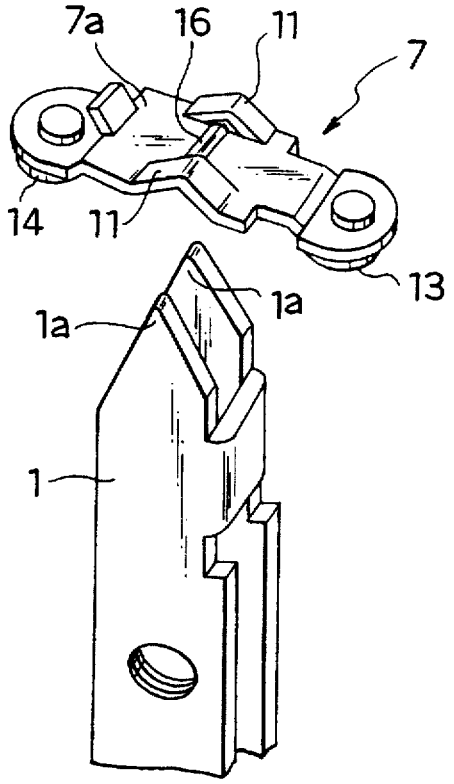
FIG. 7 is a perspective view of the common terminal or support and the up-and-down contact plate in a high-speed breaking switch according to a second embodiment of the present invention.
Figure 8:
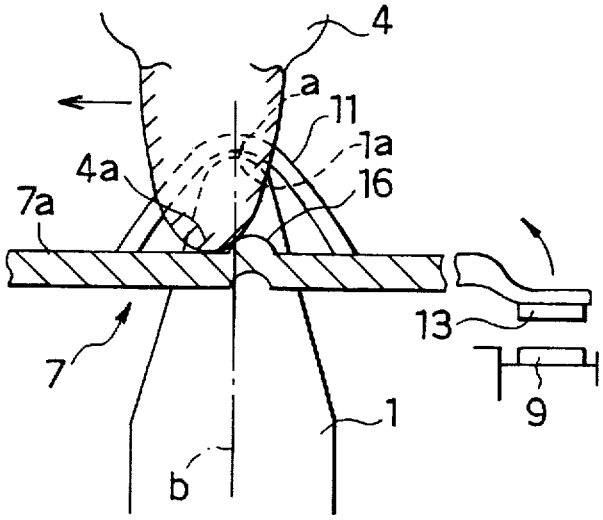
FIG. 8 illustrates how the connection-breaking is effected in the high-speed breaking switch of the second embodiment.

Referring to FIGS.7 and 8, a high-speed breaking switch of the seesaw type according to the second embodiment of the present invention is different from the first embodiment only in that the up-and-down contact plate 7 has an inverted "V"-shaped projection 16 formed on its upper surface 7*a*.

In operation the round end 4*a* of the push member 4 slides along one inclination of the inverted "V"-shaped projection 16 quickly to traverse the vertical line "b" passing through the fulcrum "a" of the up-and-down contact plate 7, thereby permitting the up-and-down contact plate 7 to turn quickly for putting the contact 13 apart from the main contact 9. Thus, the connections are broken in the electric circuit so quickly that an arc cannot appear or that an arc if permitted to appear, may be extinguished quickly.

In the seesaw type of switches according to the first and second embodiments their up-and-down contact plates 7 are described as having a ramp-and-step plateau or inverted "V"-shaped projection formed on its upper surface by stamping, but it should be understood that such a slope piece can be made separately, and that the separate piece can be fixed to the up-and-down contact plate 7.

As may be understood from the above, the fulcrum point of the up-and-down contact plate is positioned at a higher level than the level at which the push member abuts against the up-and-down contact plate, and the push member is so arranged that it may slide down along the inclination of the ramp-and-step plateau or inverted "V"-shaped projection quickly, traversing the vertical line passing through the fulcrum of the up-and-down contact plate, thus causing it to turn quickly. The rising of the fulcrum point at such high level along with the slope on the up-and-down contact plate has the effect of increasing the rotating moment of the up-and-down contact plate, thereby increasing the speed at which the connections in an associated electric circuit can be broken, thus suppressing the arc across the contact-to-contact space.

What is claimed is:

1. A high speed seesaw breaking switch comprising:

a casing;

two stationary terminals arranged at a distance from each other and in said casing;

a main and common stationary terminal arranged in said casing between said two stationary terminals;

a movable contact plate arranged on a tip end of said main terminal as a fulcrum point and having a contact at each end of said plate, said contacts being able to be contacted with respective stationary terminals;

an operation member slidingly movable in said casing along an axis;

a first spring biasing said operation member in a returning direction;

a push element arranged on one end of said operation element and aligned perpendicular to said axis; and a second spring biasing said push element to have an end thereof always slidingly in contact with a surface of said movable contact plate;

said fulcrum point of said movable contact plate being raised vertically higher than a level at which said end of said push element contacts with said movable plate;

said movable contact plate having a ramp-step on said surface engaged by said end of said push element when sliding motion of said operation member causes said end of said push element to slide across said movable contact plate, whereby said sliding motion of said operation member causes accelerated seesaw movement of said movable contact plate so that one of said contacts moves to contact with the respective stationary terminal to provide an electrical connection between said main and common stationary terminal and the respective stationary terminal contacted by said one of said contacts.

2. A seesaw switch as claimed in claim 1, wherein said tip end of said main stationary terminal has parallel tapered ends and said movable contact plate has raised fulcrum points on lateral side portions of said contact plate leaving a space therebetween, said fulcrum points riding on said parallel tapered ends.

3. A seesaw switch as claimed in claim 1, wherein said ramp-step is an inclination on said surface of said contact plate extending across a portion of said contact plate substantially corresponding to said fulcrum point.

4. A seesaw switch as claimed in claim 1, wherein said ramp-step is a projection on said surface of said contact plate positioned at a portion of said contact plate substantially corresponding to said fulcrum point.

* * * * *